US005368277A

United States Patent [19]

Moss

[11] Patent Number: 5,368,277

[45] Date of Patent: Nov. 29, 1994

[54] DEVICE FOR REMOVING METAL FENCE POSTS

[76] Inventor: Floyd Moss, 4339 Old Hillsboro Rd., Franklin, Tenn. 37064

[21] Appl. No.: 128,882

[22] Filed: Sep. 30, 1993

[51] Int. Cl.[5] ..... E21B 19/00

[52] U.S. Cl. ..... 254/30

[58] Field of Search ..... 254/29 R, 30, 31, 131, 254/132; 294/92, 104, 82.1–82.13

[56] References Cited

U.S. PATENT DOCUMENTS

| | | | |
|---|---|---|---|
| 725,923 | 4/1903 | Beeman | 254/31 |
| 961,420 | 6/1910 | Oakes | 254/31 |
| 1,107,955 | 8/1914 | James | 254/31 |
| 1,641,460 | 9/1927 | Schaffer | 254/31 |
| 2,377,652 | 6/1945 | Sanders | 254/132 |
| 2,584,902 | 2/1952 | Miller | 294/92 |
| 3,762,687 | 10/1973 | De Rome . | |
| 4,040,601 | 8/1977 | Boardman | 254/30 |
| 4,161,310 | 7/1979 | Parker | 254/30 |
| 4,422,621 | 12/1983 | Ekern | 254/30 |
| 4,726,565 | 2/1988 | Keller | 254/30 |
| 4,738,433 | 4/1988 | Hoff | 254/30 |
| 4,792,120 | 12/1988 | Egaas . | |
| 5,011,117 | 4/1991 | Youngblood . | |
| 5,052,659 | 10/1991 | Bates . | |
| 5,161,781 | 11/1992 | Sohocki . | |

*Primary Examiner*—Robert C. Watson
*Attorney, Agent, or Firm*—I. C. Waddey, Jr.

[57] ABSTRACT

The present application discloses a fence post remover for use in connection with a "T"-shaped post. A bracket engages the edge of the web of the fence post. A clevice is placed over the fence post and around the "T"-shape of the fence post until it engages the front face, the seam, or the teeth of the fence post. A "U"-shaped brace is attached to a corner of the bracket to engage the web of the fence post. The clevice and the bracket are pinned together. A ring is provided to receive the pulling force such that when the ring is pulled upwardly, the portion of the clevice proximate to the face of the fence post is pulled inwardly toward the fence post while at the same time the "U"-shaped brace is also pulled toward the fence post thereby taking advantage of the pulling force to provide a better grip on the fence post.

3 Claims, 2 Drawing Sheets

DEVICE FOR REMOVING METAL FENCE POSTS

BACKGROUND OF THE INVENTION

The present invention relates generally to a force application device and more particularly to a device for removing posts from their support base and specifically for removing from the ground metal fence posts that have been driven into the ground for stability.

It will be appreciated by those skilled in the art that the most popular type of man-made fence post is a metal (preferably steel) post having a cross section that is "T"-shaped. This fence post has a web joined approximately perpendicularly to two flanges to form the "T". The flanges come together to form a face on the side distal from the web. On the face, there is usually a seam and/or teeth. The web wire fencing is strung by attaching the wire to the seams or teeth of the posts.

As fences are moved or removed, a need arises to pull up the posts that have been driven into the ground for stability. This can generally be accomplished efficiently only with some mechanical aid. To this end, there have been several attempts to provide such a device.

U.S. Pat. No. 3,762,687 issued on Oct. 2, 1973, discloses a post pulling apparatus which has two plates having a "T"-shaped hole. The plates are placed over the fence post and a chain is attached to the ends of the plates so that the plates are pulled toward each other thereby causing friction against the post. The chain is then pulled upwardly using a pulling force such as a three point hitch. Unfortunately, this device requires the use of some type of mechanical pulling force such as three point hitch and can not be used by the individual with anything as simple as a lever. Further, in order to get good friction, the holes in the plates must be very small thereby decreasing the flexibility to be used with varying types and sizes of "T"-shaped fence.

U.S. Pat. No. 4,040,601 to Boardman discloses a fence post remover. In order to use the Boardman device, a hook or a pipe must be placed through a hole of limited size thereby making it difficult to use. This limited opening can be difficult to use if, as in wooded areas, the area against which the lever can be placed is very limited by trees, bushes, and rocks. Further, if the hook portion of the Boardman device is used, the same limitation occurs.

U.S. Pat. No. 4,161,310 issued to Parker on Jul. 17, 1979, discloses a fence post puller that includes a lever and a fulcrum which is attached to a device which is substantially square. This device does not have the flexibility to be capable of use in connection with a three point hitch. Further, if it is manually used, it is difficult to carry around as the fulcrum adds additional weight.

U.S. Pat. No. 4,422,321 issued to Ekern on Dec. 27, 1983, discloses a U-shaped bracket which is attached to a chain. The U-shaped bracket is placed over the fence and then a pin is placed through it to engage the "T" of the fence post. However, the pin can easily roll upwardly along the slot thereby disengaging from the teeth. Therefore, instead of using the force to assist the friction fit, the force will actually decrease the friction.

U.S. Pat. No. 4,726,565 issued to J. Keller on Feb. 23, 1988, discloses a fence puller which is very similar to and has all the same limitations of the Parker reference discussed above.

U.S. Pat. No. 4,738,433 issued to Hoff on Apr. 19, 1988, has the same limitations as the Parker referenced above.

U.S. Pat. No. 4,792,120 issued to R. Egaas on Dec. 20, 1988, is used in connection with a fence post having a different shape.

U.S. Pat. No. 5,011,117 issued to Youngblood, et al on Apr. 30, 1991, discloses a post puller. This post puller is essentially a "U" shaped clamp that fits on the front and rear of the post but fails to fully take advantage of the mechanical pulling force.

U.S. Pat. No. 5,052,659 issued to S. Bates on Oct. 1, 1991, discloses a stake puller that is very complex in nature. It is not intended for use with a "T"-shaped fence post and therefore does not take advantage of the unique shape of the "T"-shaped fence post.

What is needed, then, is a fence post puller which can take advantage of the upward pulling force. This fence post puller must have sufficient universality to be used with both a lever as well as other mechanical forces such as a tractor with a three point hitch. This device for removing posts is presently lacking in the prior art.

SUMMARY OF THE INVENTION

The present application discloses a fence post remover for use in connection with a "T"-shaped post. A bracket engages the edge of the web of the fence post. A clevice is placed over the fence post and around the "T"-shape of the fence post until it engages the front face, the seam, or the teeth of the fence post. A "U"-shaped brace is attached to a corner of the bracket to engage the web of the fence post. The clevice and the bracket are pinned together. A ring is provided to receive the pulling force such that when the ring is pulled upwardly, the portion of the clevice proximate to the face of the fence post is pulled inwardly toward the fence post while at the same time the "U"-shaped brace is also pulled toward the fence post thereby taking advantage of the pulling force to provide a better grip on the fence post.

One object of the present invention is to provide a device for pulling fence posts.

Still another object of the present invention is to provide a device which directs the upwardly pulling force to provide a better grip on the fence post.

A still further object of the present invention is to provide a device which can be used either with a lever so that the individual may use it by with a lever or with a three point hitch.

A still further object of the present invention is to provide a simple device which requires limited space for its use.

DESCRIPTION OF THE PREFERRED EMBODIMENT

Figure 1:
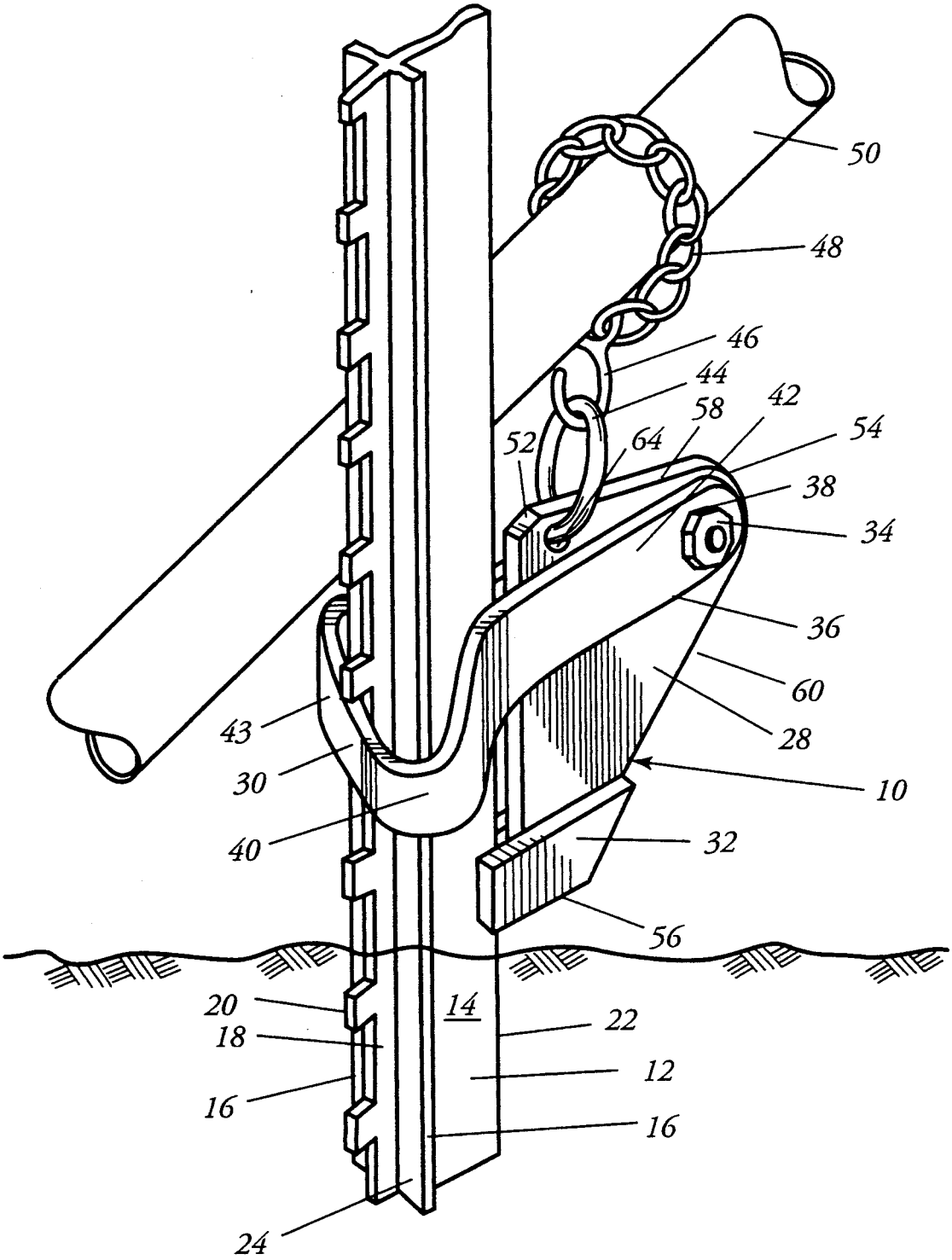
FIG. 1 is a perspective view showing the operation of the device of the present invention on a fence post.

Referring now to FIG. 1 there is shown generally at 10 the device for removing metal fence posts. In FIG. 1, device 10 is shown to engage fence post 12. In the preferred embodiment, the device 10 is designed for use in connection with the pulling of fence post 12 that is a "T"-shaped post. This "T"-shaped post 12 has web 14 attached substantially perpendicularly to flanges 16 to form a "T". Web 14 has edge 22 which is distal from flanges 16. Flanges 16, on face 24 distal from web 14, usually has seam 18 and teeth 20. FIG. 1 shows post 12 in ground 26. Device 10 has bracket 28 which is, in the preferred embodiment, substantially triangular having first corner 52, second corner 54, third corner 56, first side 58, second side 60, and third side 62. Third side 62 of bracket 28 is placed against edge 22 of web 14. Opening 64 is placed through bracket 28 proximate to first corner 52. Hole 36 is placed through bracket 28 proximate to second comer 54.

Brace 32 is substantially "U"-shaped in cross-section and attached to third corner 56. In the preferred embodiment, the U-shaped cavity of brace 32 surrounds edge 22 of flanges 16. Clevice 30 has distal section 42, proximal section 43, and loop section 40. Loop section 40 is placed over flanges 16 such that proximal section 43 comes close to and eventually contacts either face 24, seam 18, and/or teeth 20. Clevice 30, proximate to distal section 42, has orifice 38. In the preferred embodiment, pin 34 passes through orifice 38 and hole 36 to pivotally attach clevice 30 and bracket 28. In the preferred embodiment, ring 44 is attached to bracket 28 through opening 64.

When device 10 is placed on fence post 12 at the desired point, hook 46 is attached to ring 44. Hook 46 also is attached to chain 48. Lever 50 is placed through chain 48 until end of lever 50 contacts ground 26. User can then pull up the end of lever 50 away from ground 26 to pull fence post 12 out of ground. As pulling force or upward force is applied to ring 44, proximal section 43 tightens against face 24, teeth 20, or seam 18 to provide a more secure frictional fit against post 12. Similarly, as pulling force is applied against ring 44, brace 32 is forced in toward and against edge 22 thereby providing a greater frictional fit. These two actions created by pivotally attaching clevice 30 and bracket 28 prevent device 10 from slipping upwardly.

Figure 2:
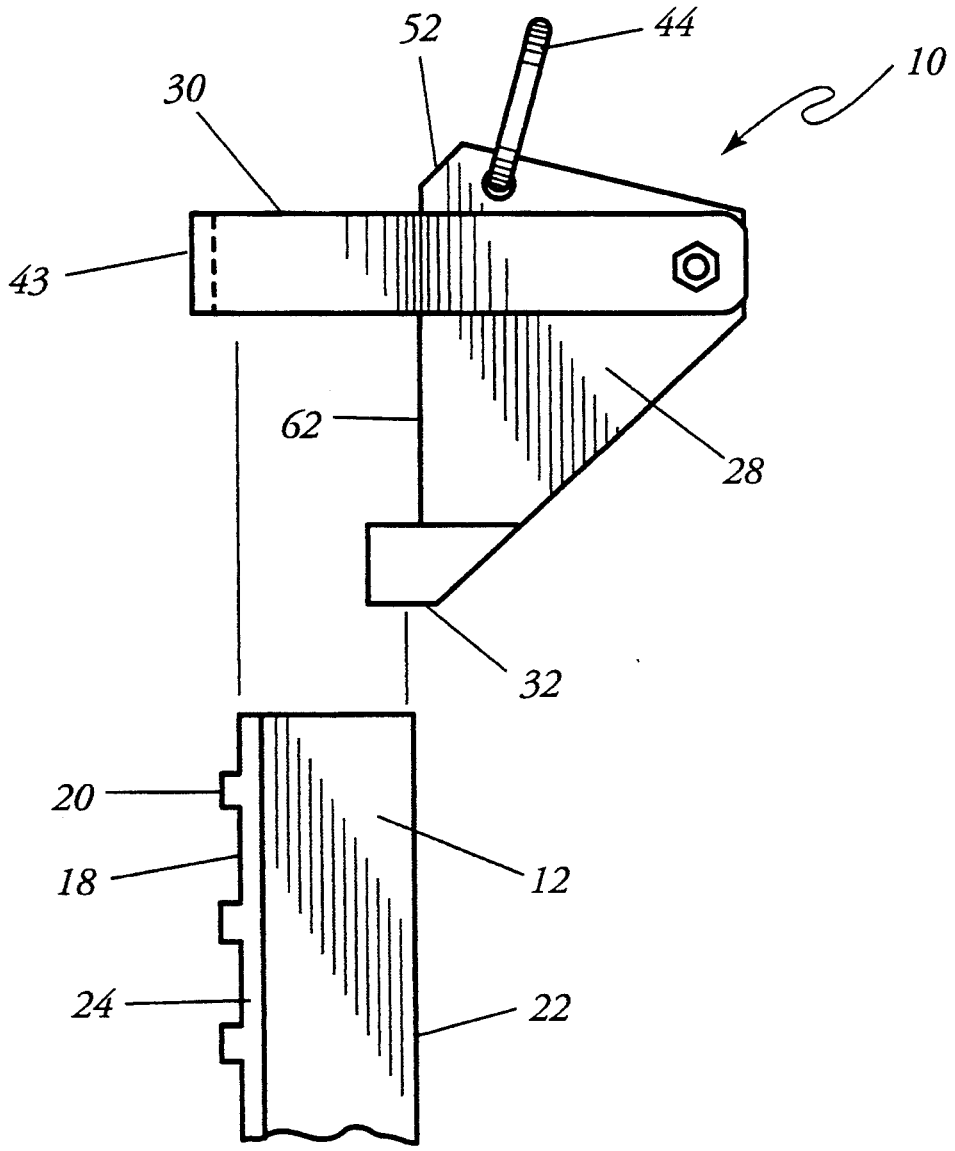
FIG. 2 is a side exploded view showing the device before it is placed over the fence post.

Referring now to FIG. 2 there is shown generally at 10 the device of the present invention as it is about to be placed over fence post 12. As can be seen, brace 32 travels along edge 22 of fence post 12 as does third side 62. If for some reason, bracket 28 flips downwardly in the view shown in FIG. 2, cut-out 66 allows bracket 28 to be placed back into place without running into edge 22. Clevice 30 is then placed over fence post 12. Proximal section 43 passes along and over teeth 20 until the desired point along fence post 12 is reached. Pulling force is applied to ring 44 which causes brace 32 to approach edge 22 and proximal section 43 to approach either seam 18 or face 24.

Figure 3:
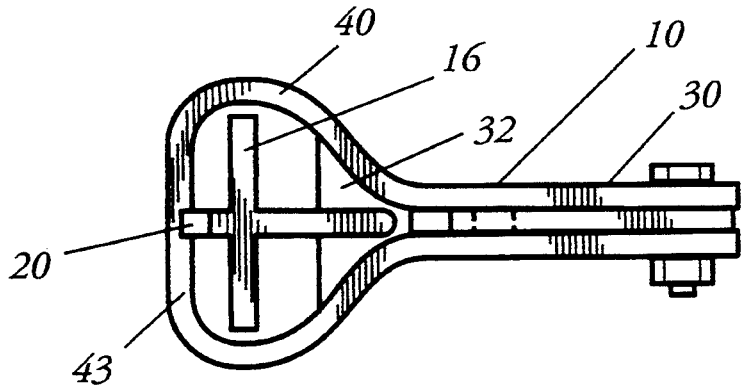
FIG. 3 is a plan view of the device as it engages a fence post.

Referring now to FIG. 3 there is shown generally at 10 still another view of the present invention. In this view, it can be seen how loop section 40 of clevice 30 passes over and around flanges 16 and how proximal section 43 engages teeth 20.

The discussion of FIG. 1 shows that pulling force could be a lever. This is the simplest application and takes up the least amount of room. However, pulling force can also be from a crane or a tractor having a three point hitch. If either of these mechanical versions is used, hook 46 is merely attached to a chain which is attached to either the cringe or the three point hitch. In certain instances, such as when using a crane, the crane already has a hook which then engages ring 44.

Thus, although there have been described particular embodiments of the present invention of a new and useful device for removing posts, it is not intended that such references be construed as limitations upon the scope of this invention except as set forth in the following claims.

What I claim is:

1. A device for removing from an embedded position in the ground a "T"-shaped post having a web including an edge, said web being joined to two flanges distal from said edge and said flanges having a seam having teeth on a side of said flanges distal from said web, said device comprising:

a. a bracket having a first corner, a second corner, a third corner, a first side, a second side, and a third side;

b. a brace, "U"-shaped in cross-section, attached proximate said third corner and aligned and positioned to receive said web when said device is placed over said post;

c. connector means at said first corner to receive force applying means for applying a pulling force to said device and wherein said connector means functions to limit the extent to which said bracket can pivot in relation to said clevice;

d. a clevice having a loop section, a proximal section and a distal section, said loop section having a shape that compliments the cross sectional shape of said post such that when said clevice is placed over said post, said proximal section can engage said teeth; and e. means pivotally connecting said bracket at its second corner to the distal end of said clevice.

2. A device for removing from an embedded position in the ground a "T"-shaped post having a web including an edge, said web being joined to two flanges distal from said edge and said flanges having a seam having teeth on a side of said flanges distal from said web, said device comprising:

a. a bracket having a first corner, a second corner, a third corner, a first side, a second side, and a third side;

b. a brace, "U"-shaped in cross-section, attached proximate said third corner and aligned and positioned to receive said web when said device is placed over said post;

c. connector means at said first corner to receive force applying means for applying a pulling force to said device;

d. a clevice having a loop section, a proximal section and a distal section, said loop section having a shape that compliments the cross sectional shape of said post such that when said clevice is placed over said post, said proximal section can engage said teeth; and e. means pivotally connecting said bracket at its second corner to the distal end of said clevice wherein said brace limits the extent to which said bracket can pivot in relation to said clevice.

3. A device for removing from an embedded position in the ground a "T"-shaped post having a web including an edge, said web being joined to two flanges distal from said edge and said flanges having a seam having teeth on a side of said flanges distal from said web, said device comprising:

a. a bracket having a first corner, a second corner, a third corner, a first side, a second side, and a third side;

b. a brace, "U"-shaped in cross-section, attached proximate said third corner and aligned and positioned to receive said web when said device is placed over said post;

c. connector means at said first corner to receive force applying means for applying a pulling force to said device;

d. a clevice having a loop section, a proximal section and a distal section, said loop section having a shape that compliments the cross sectional shape of said post such that when said clevice is placed over said post, said proximal section can engage said teeth; and e. means pivotally connecting said bracket at its second corner to the distal end of said clevice wherein said connector means functions to limit the extent to which said bracket can pivot in relation to said clevice in one direction and said brace limits the extent to which said bracket can pivot in relation to said clevice in an opposite direction.

* * * * *